US011133616B2

(12) United States Patent
Meng et al.

(10) Patent No.: US 11,133,616 B2
(45) Date of Patent: Sep. 28, 2021

(54) BOARD-TO-BOARD ELECTRICAL CONNECTOR FASTENING AND POSITIONING MEMBERS

(71) Applicant: ADVANCED-CONNECTEK INC., New Taipei (TW)

(72) Inventors: Ta-Teh Meng, New Taipei (TW); Mei Shi, New Taipei (TW); Ya-Ping Liang, New Taipei (TW); Ping Shi, New Taipei (TW); Meng Liu, New Taipei (TW); Jing-Zhe Wang, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 16/884,525

(22) Filed: May 27, 2020

(65) Prior Publication Data

US 2020/0381856 A1 Dec. 3, 2020

(30) Foreign Application Priority Data

May 29, 2019 (CN) ..... 201920791065.0

(51) Int. Cl.
*H01R 12/71* (2011.01)
*H01R 13/115* (2006.01)
*H01R 13/04* (2006.01)
*H01R 12/70* (2011.01)

(52) U.S. Cl.
CPC ..... *H01R 13/115* (2013.01); *H01R 12/707* (2013.01); *H01R 12/716* (2013.01); *H01R 13/04* (2013.01)

(58) Field of Classification Search
CPC .. H01R 13/04; H01R 13/115; H01R 13/6275; H01R 12/716; H01R 12/73; H01R 12/7052; H01R 12/7011
See application file for complete search history.

(56) References Cited

U.S. PATENT DOCUMENTS

| | | | | |
|---|---|---|---|---|
| 9,543,675 | B1 * | 1/2017 | Takenaga | H01R 12/716 |
| 9,577,379 | B2 * | 2/2017 | Arichika | H01R 24/60 |
| 9,666,963 | B2 * | 5/2017 | He | H01R 12/7088 |
| 10,396,484 | B2 * | 8/2019 | Chen | H01R 12/7088 |

* cited by examiner

*Primary Examiner* — Vanessa Girardi
(74) *Attorney, Agent, or Firm* — Muncy, Geissler, Olds & Lowe, P.C.

(57) ABSTRACT

A first connector and a second connector are provided. The first connector includes an insulated body, first terminals, and fastening members. The first terminals and the fastening members are on the insulated body. The second connector includes an insulated base, second terminals, and positioning members. The fastening member has a first side plate and a second side plate formed as a stair structure for protecting the insulated body.

12 Claims, 8 Drawing Sheets

BOARD-TO-BOARD ELECTRICAL CONNECTOR FASTENING AND POSITIONING MEMBERS

CROSS-REFERENCE TO RELATED APPLICATION

This non-provisional application claims priority under 35 U.S.C. § 119(a) to Patent Application No. 201920791065.0 filed in China, P.R.C. on May 29, 2019, the entire contents of which are hereby incorporated by reference.

FIELD OF THE INVENTION

The instant disclosure relates to an electrical connector, and more particular to a board-to-board electrical connector.

BACKGROUND

Consumer electronics tend to become smaller, thinner, and lighter. Hence, electrical connections are usually established between different circuit boards in the consumer electronics. For such electronic device, as the size of the electronic device is small, the electronic device has a relatively limited internal space. Therefore, the circuit boards are electrically connected with each other through board-to-board (BTB) electrical connector(s), so that the electronic device can have better space utilization.

SUMMARY OF THE INVENTION

The BTB electrical connector is an electrical connector assembly. The electrical connector assembly comprises a first connector and a second connector corresponding to the first connector. The first connector is arranged with a plurality of first terminals and a plurality of fastening pieces. The second connector is arranged with a plurality of second terminals and a plurality of positioning pieces. When the first connector is inserted into the second connector, the first terminals are mated with the second terminals to achieve the signal transmission between two printed circuit boards. In general, an elastic arm extends from the positioning piece, and the elastic arm is an inwardly extending structure. As a result, the elastic arms for contacting the fastening pieces are narrow arm structures with small contact areas.

An embodiment of the instant disclosure provides a first connector. The first connector comprises an insulated body, a plurality of first terminals, and a plurality of fastening members. The insulated body comprises a pair of first side walls and a pair of first end walls. The pair of first side walls and the pair of first end walls are enclosed to form a first connection space. A position of the second side surface is different from a position of the first side surface. The first terminals are held in the pair of first side walls. Each of the fastening members comprises a first covering plate, a plurality of first side plates, a plurality of second side plates. Each of the first covering plates is held in an outer surface of each of the first end walls. An end top plate extends from each of the first covering plates and covers a top portion of each of the first end walls. An end contact sheet is in the first connection space and bends inwardly from the end top plate, and the end contact sheet covers an inner surface of each of the first end walls. The first side plates bend and extend from two sides of the end top plate of each of the first covering plates. The second side plates bend and extend from two sides of the end top plate of each of the first covering plates toward the second side surfaces.

In some embodiments, a width between two opposite of the first side surfaces of the pair of first side walls is greater than a width between two opposite of the second side surfaces of the pair of first side walls.

In some embodiments, a width between two opposite of the first side plates is greater than a width between two opposite of the second side plates.

In some embodiments, a surface of each of the first side walls comprises a plurality of blocks. Each of the blocks is between each of the first side plates and each of the second side plates adjacent to the first side plate.

In some embodiments, a bottom end of each of the first covering plates comprises a plurality of legs extending out of each of the first side walls.

Another embodiment of the instant disclosure provides a second connector for mating with the foregoing first connector. The second connector comprises an insulated base, a plurality of second terminals, and a plurality of positioning members. The insulated base comprises a pair of second side walls and a pair of second end walls. The pair of second side walls and the pair of second end walls are enclosed to form a second connection space. The insulated base comprises a guiding column in an inner portion of the second connection space. A position of the second side surface is different from a positon of the first side surface. The second terminals are respectively held in the pair of second side walls and two sides of the guiding column. Each of the positioning members comprises a second covering plate and a plurality of second side plates. Each of the second covering plates is held in an outer surface of each of the second end walls. An end top plate extends from each of the second covering plates and covers a top portion of each of the second end walls. An end contact sheet is in the second connection space and bends inwardly from the end top plate, and the end contact sheet covers an inner surface of each of the second end walls. Each of the second side plates is held in an outer surface of each of the second side walls. A first side top plate and a second side top plate extend from each of the second side plates and cover a top portion of each of the second side walls. Each of the second side plates comprises a side contact sheet and a plurality of contact arms. Each of the side contact sheets is in the second connection space and bends inwardly from each of the first side plates, and each of the side contact sheets covers each of the first side surfaces. Each of the contact arms is in the second connection space and bends inwardly from each of the second side top plates, and each of the contact arms covers each of the second side surfaces.

In some embodiments, a width between two opposite of the first side surfaces of the pair of second side walls is less than a width between two opposite of the second side surfaces of the pair of second side walls.

In some embodiments, each of the contact arms comprises an extension arm and an elastic arm. The extension arm extends toward an inner portion of the second connection space. The elastic arm extends and bends from an end portion of the extension arm.

In some embodiments, a width between two opposite of the elastic arms is less than a width between two opposite of the side contact sheets.

In some embodiments, a width between two opposite of the side contact sheets is less than a width between two opposite of the first side surfaces.

According to one or some embodiments of the instant disclosure, the fastening member is an enclosing structure. The first covering plates, the first side plates, and the second side plates respectively cover the pair of first side walls and the pair of first end walls of the insulated body, so that the first covering plates, the first side plates, and the second side plates provide multi-point contacts. Accordingly, as the connector has two or more contact points, the stability of current output can be ensured, the requirements for large-current transmission can be achieved, and the heat generated by the elements can be reduced. The connector is applicable for quick charging purposes.

According to one or some embodiments of the instant disclosure, the fastening member has a first side plate and a second side plate formed as a stair structure for protecting the insulated body. The configuration of the fastening member is suitable for mating with the contact arm of the second connector, so that the contact arm is configured to extend to form the extension arm and the elastic arm with longer lengths, providing better elastic recovery effect, thereby reducing the risk of elastic fatigue as well as the risk of contact failure. Moreover, the extension arm and the elastic arm of the contact arm of the second connector have the same width (instead of an inwardly extending structure), and the contact area between the elastic arm and the fastening member is large.

According to one or some embodiments of the instant disclosure, the positioning member is a large-area enclosing structure. The second covering plates and the second side plates respectively cover the pair of second side walls and the pair of second end walls of the insulated base. Hence, impacts from outside can be stood effectively and the mating/unmating times for the connector can be increased. Moreover, the end contact sheets, the side contact sheets, and the contact arms provide multi-point contacts. Accordingly, as the connector has two or more contact points, the stability of large current output can be ensured, and the mating force for the connector can be increased.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
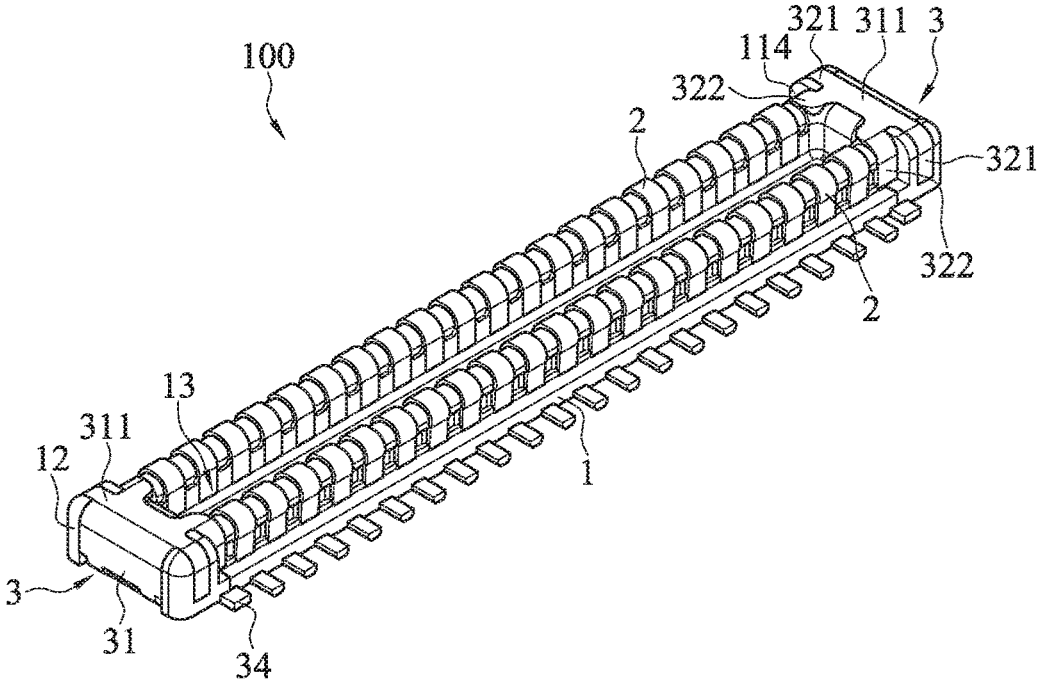
FIG. 1 illustrates a perspective view of a first connector according to a first embodiment of the instant disclosure.
Figure 2:
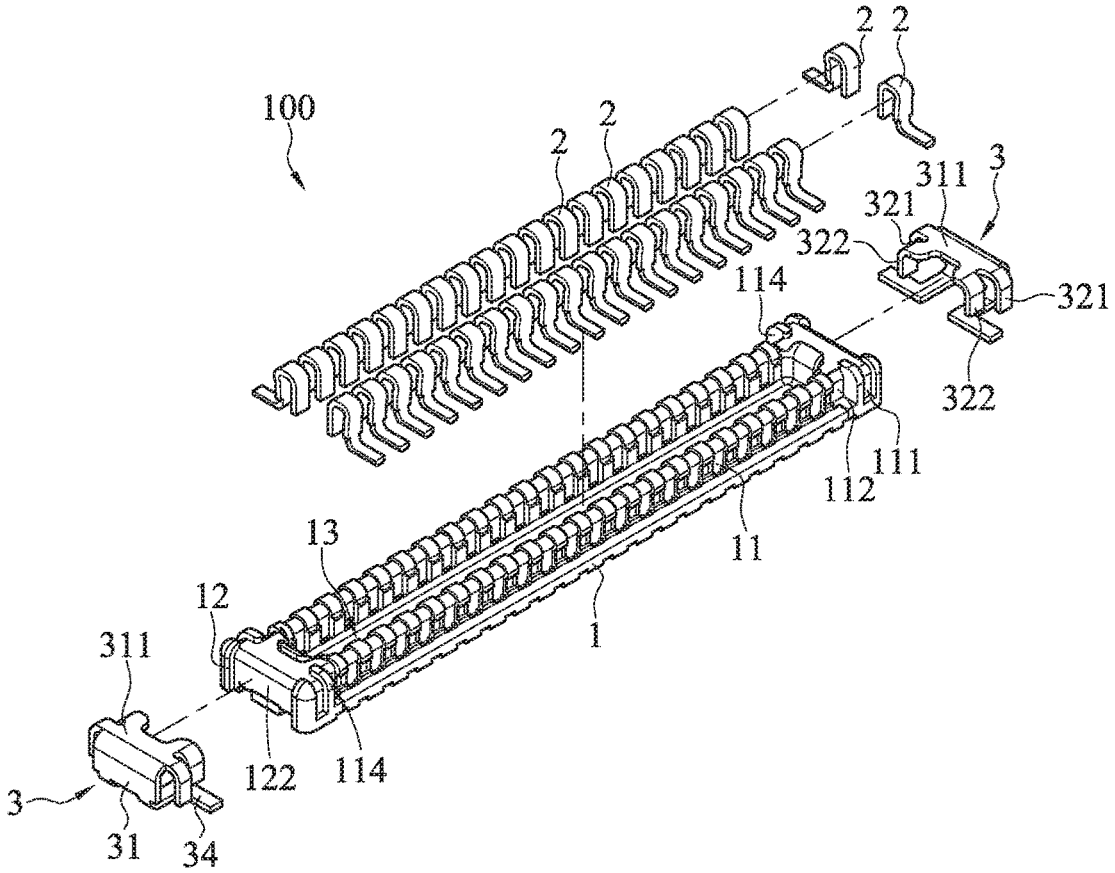
FIG. 2 illustrates an exploded view of the first connector of the first embodiment.
Figure 3:
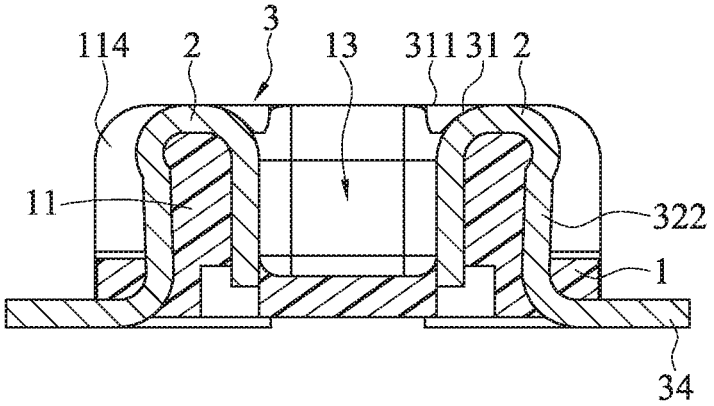
FIG. 3 illustrates a front cross-sectional view of the first connector of the first embodiment.
Figure 4:
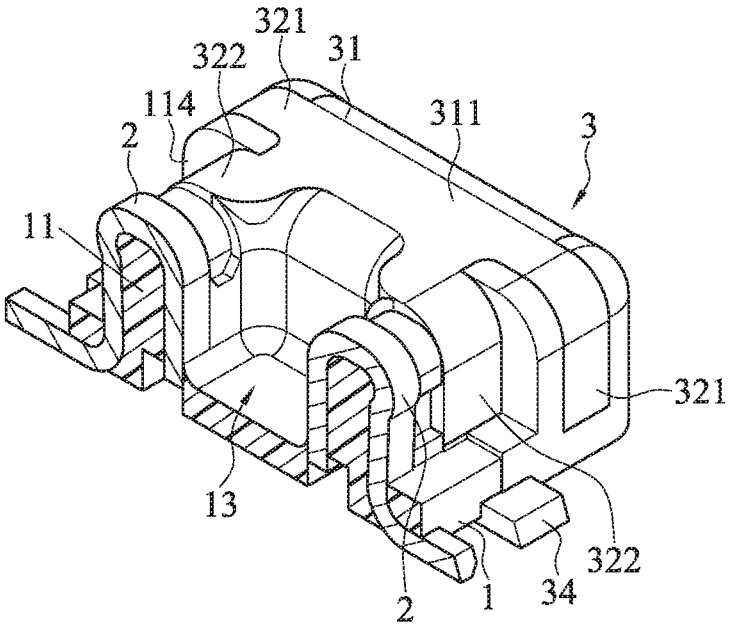
FIG. 4 illustrates a perspective sectional view of the first connector of the first embodiment.
Figure 5:
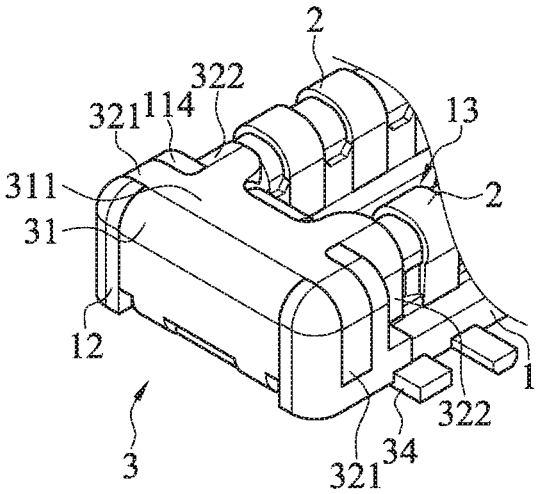
FIG. 5 illustrates a partial perspective view of the first connector of the first embodiment.
Figure 6:
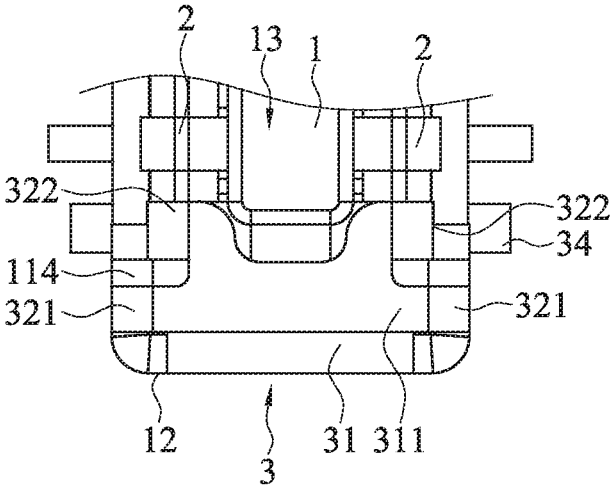
FIG. 6 illustrates a partial top view of the first connector of the first embodiment.
Figure 7:
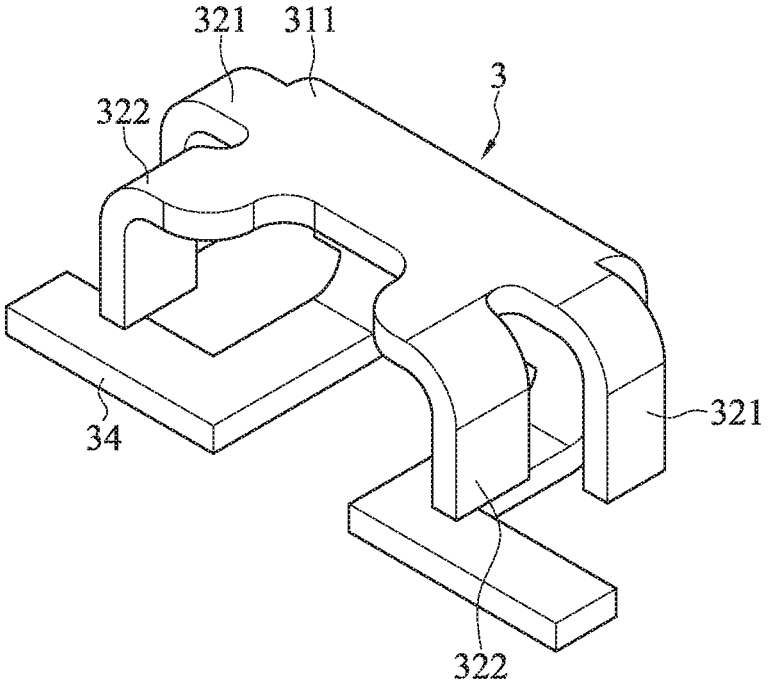
FIG. 7 illustrates a perspective view of a fastening member of the first connector of the first embodiment.

Please refer to FIGS. 1 to 7, a first connector 100 according to a first embodiment of the instant disclosure is illustrated. FIG. 1 illustrates a perspective view thereof, FIG. 2 illustrates an exploded view thereof, FIG. 3 illustrates a front cross-sectional view thereof, FIG. 4 illustrates a perspective sectional view thereof, FIG. 5 illustrates a partial perspective view thereof, FIG. 6 illustrates a partial top view thereof, and FIG. 7 illustrates a perspective view of a fastening member thereof. In this embodiment, the first connector 100 comprises an insulated body 1, a plurality of first terminals 2, and a plurality of fastening members 3 (hold down).

In this embodiment, the insulated body 1 is an elongated plastic body, which is an integrally molded main body made of an insulating material. The insulated body 1, which has a rectangular thick plate-like shape, comprises a bottom wall, a pair of first side walls 11, and a pair of first end walls 12. The pair of first side walls 11 is opposite to and parallel to each other. The pair of first end walls 12 is opposite to and parallel to each other. In particular, in one embodiment, the pair of first side walls 11 is arranged on the bottom wall in a longitudinal direction X, the pair of first end walls 12 is arranged on the bottom wall in a transverse direction Y, and the pair of first side walls 11 and the pair of first end walls 12 are enclosed to form a first connection space 13. The pair of first side walls 11 and the pair of first end walls 12 form a rectangular structure.

In this embodiment, an outer surface of each of the first side walls 11 comprises a first side surface 111 and a second side surface 112, and a position of the second side surface 112 is different from a position of the first side surface 111.

In this embodiment, more specifically, two ends of the pair of first side walls 11 comprise first side surfaces 111 and second side surfaces 112. A width between two opposite of the first side surfaces 111 of the pair of first side walls 11 is greater than a width between two opposite of the second side surfaces 112 of the pair of first side walls 11. Two opposite first side surfaces 111 and two opposite second side surfaces 112 are at both ends of the insulated body 1, respectively. The first side surface 111 and the second side surface 112 at the side portion of one end of the insulated body 1 are adjacent to each other and at different horizontal planes. Hence, the first side surface 111 and the second side surface 112 adjacent to the first side surface 111 form a stair structure.

In this embodiment, the first terminals 2 are held in the pair of first side walls 11.

In this embodiment, more specifically, the first terminals 2 are arranged on the insulated body 1 and arranged in two opposite rows. Each of the first terminals 2 comprises a first contact portion, a second contact portion, and a first tail portion integrally formed with each other, and the first tail portion extends out of the insulated body 1. The first contact portion and the second contact portion are bent, folded, and arranged side by side. The first contact portion is in the first connection space 13 and abutted against one of two surfaces of the first side wall 11. The second contact portion is at the other surface of the first side wall 11. The first terminals 2 are used for signal transmission, and the transmission current is from 0.3 to 0.5 A.

In this embodiment, each of the fastening members 3 comprises a first covering plate 31, a plurality of first side plates 321, and a plurality of second side plates 322 integrally formed with each other.

In this embodiment, each of the first covering plates 31 is held in an outer surface 122 of each of the first end walls 12. An end top plate 311 extends from each of the first covering plates 31 and covers a top portion of each of the first end walls 12. More specifically, in this embodiment, the first covering plates are at the outer surfaces 122 of the first end walls 12 at two ends of the insulated body 1.

In this embodiment, the first side plates 321 bend and extend from two sides of the end top plate 311 of each of the first covering plates 31 toward the first side surfaces 111.

In this embodiment, the second side plates 322 bend and extend from the two sides of the end top plate 311 of each of the first covering plates 31 toward the second side surfaces 112.

In this embodiment, more specifically, from a top view, each of the fastening members 3 is approximately formed as an upside-down U-shaped plate. A width between two opposite of the first side plates 321 is greater than a width between two opposite of the second side plates 322. Two opposite first side plates 321 and two opposite second side plates 322 are at both ends of the insulated body 1, respectively. The first side plate 321 and the second side plate 322 at the side portion of one end of the insulated body 1 are adjacent to each other and at different horizontal planes. Hence, the first side plate 321 and the second side plate 322 adjacent to the first side plate 321 form a stair structure.

In this embodiment, more specifically, a surface of each of the first side walls 11 comprises a plurality of blocks 114. Each of the blocks 114 is between each of the first side plates 321 and each of the second side plates 322 adjacent to the first side plate 321.

In this embodiment, the fastening member 3 is an enclosing structure. Moreover, the first covering plates 31, the first side plates 321, and the second side plates 322 cover the pair of first side walls 11 and the pair of first end walls 12 of the insulated body 1 to increase the structural strength of the connector products. Hence, the first covering plates 31, the first side plates 321, and the second side plates 322 provide multi-point contacts. Accordingly, as the connector has two or more contact points, the stability of current output can be ensured, the requirements for large-current transmission can be achieved, and the heat generated by the elements can be reduced. The connector is applicable for quick charging purposes.

In this embodiment, more particularly, the material of the fastening member 3 may be replaced according to different requirements, for example, a material specified in large-current (3 A to 5 A or 3 A to 10 A) or signal source transmission can be chosen as the material of the fastening member 3.

In this embodiment, more specifically, a bottom end of each of the first covering plates 31 comprises a plurality of legs 34 extending out of each of the first side walls 11, and the legs are provided for welding on a circuit board.

Figure 8:
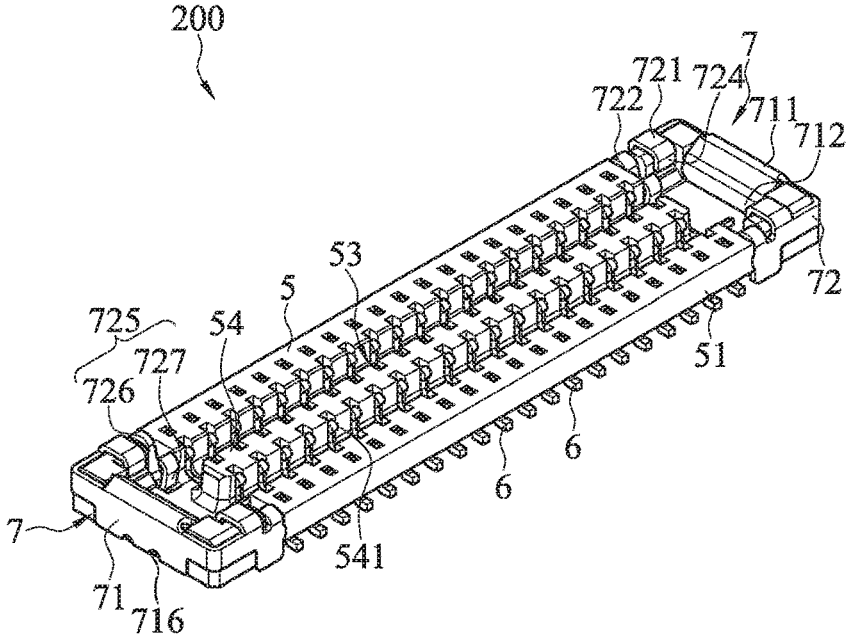
FIG. 8 illustrates a perspective view of a second connector according to a second embodiment of the instant disclosure.
Figure 9:
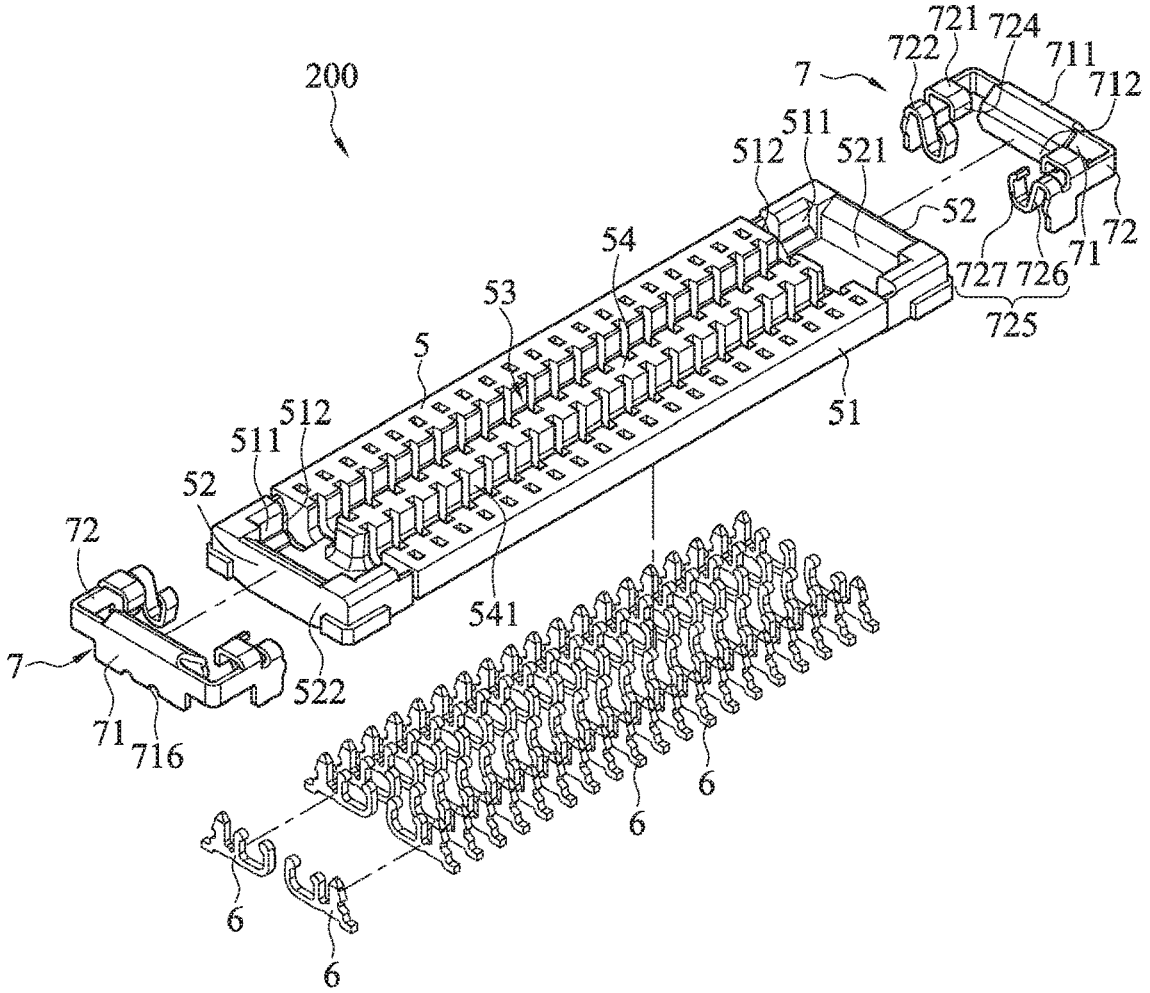
FIG. 9 illustrates an exploded view of the second connector of the second embodiment.
Figure 10:
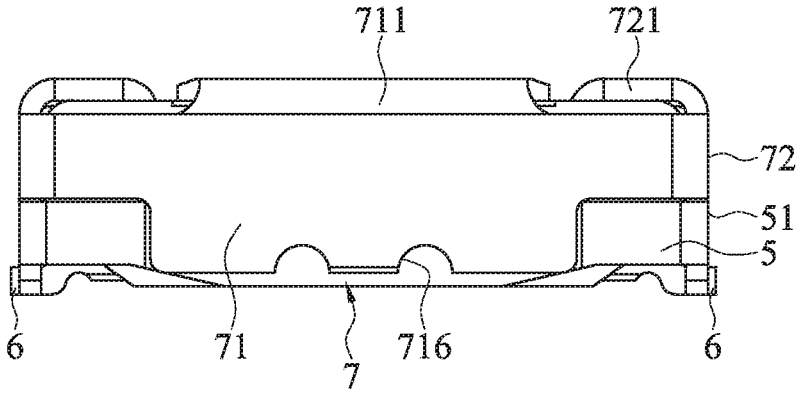
FIG. 10 illustrates a front view of the second connector of the second embodiment.
Figure 11:
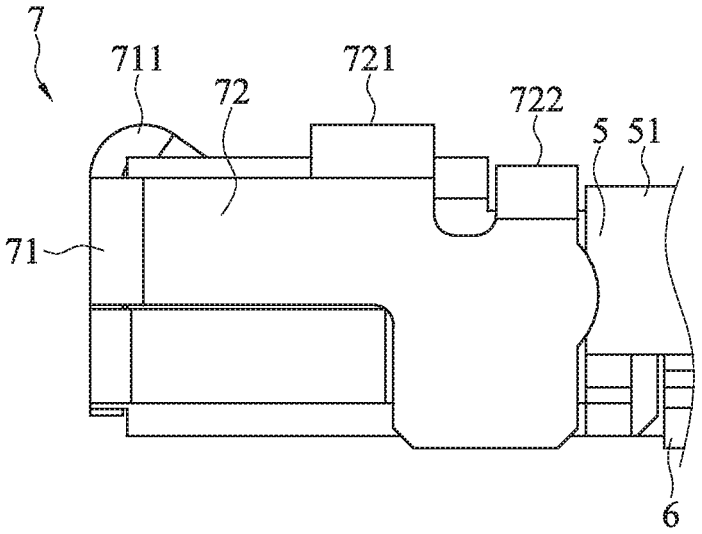
FIG. 11 illustrates a side view of the second connector of the second embodiment.
Figure 12:
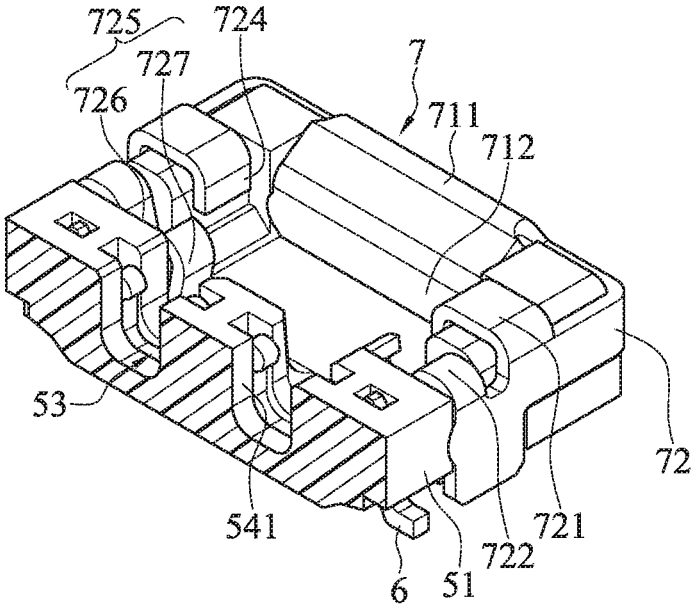
FIG. 12 illustrates a partial perspective sectional view of the second connector of the second embodiment.
Figure 13:
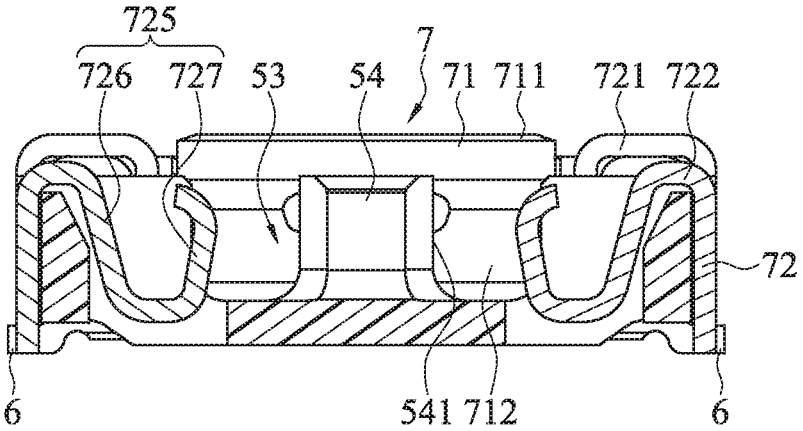
FIG. 13 illustrates a partial cross-sectional view of the second connector of the second embodiment.
Figure 14:
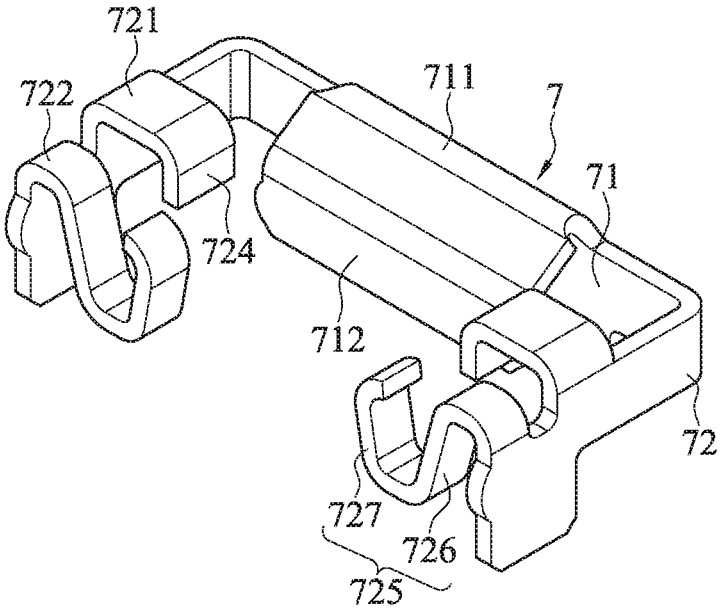
FIG. 14 illustrates a perspective view of a positioning member of the second connector of the second embodiment.

Please refer to FIGS. 8 to 14, a second connector according to a second embodiment of the instant disclosure is illustrated. FIG. 8 illustrates a perspective view thereof, FIG. 9 illustrates an exploded view thereof, FIG. 10 illustrates a front view thereof, FIG. 11 illustrates a side view thereof, FIG. 12 illustrates a partial perspective sectional view thereof, FIG. 13 illustrates a partial cross-sectional view thereof, and FIG. 14 illustrates a perspective view of a positioning member thereof. In this embodiment, the second connector 200 comprises an insulated base 5, a plurality of second terminals 6, and a plurality of positioning members 7.

Figure 15:
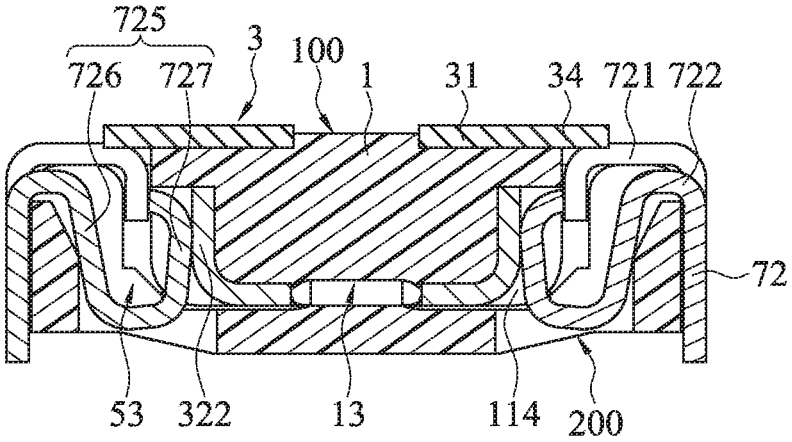
FIG. 15 illustrates a cross-sectional view showing that a first connector is mated with a second connector according to a third embodiment of the instant disclosure.

In this embodiment, the insulated base 5 is an elongated plastic body. The insulated base 5 comprises a bottom wall, a pair of second side walls 51, and a pair of second end walls 52. The pair of second side walls 51 is arranged on the bottom wall along a longitudinal direction X, the pair of second end walls 52 is arranged on the bottom wall along a transverse direction Y, and the pair of second side walls 51 and the pair of second end walls 52 form a second connection space 53. The pair of second side walls 51 and the pair of second end walls 52 form a rectangular structure. When the first connector 100 is inserted into the second connector 200 (as shown in FIGS. 4, 12, and 15), the pair of first side walls 11 is inserted into the second connection space 53.

In this embodiment, the insulated base 5 comprises a guiding column 54 in the second connection space 53, that is, in this embodiment, the bottom wall of the second connector 200 comprises a guiding column 54 protruding toward the interior of the second connection space 53. A plurality of terminal slots is respectively arranged on the inner side surfaces of the pair of second side walls 51 and both sides 541 of the corresponding guiding column 54, and the terminal slots are arranged along the longitudinal direction X. The terminal slots are defined through the bottom wall and communicate with the second connection space 53.

In this embodiment, an inner surface of each of the second side walls 51 comprises a first side surface 511 and a second side surface 512, and a position of the second side surface 512 is different from a position of the first side surface 511. More specifically, in this embodiment, the inner surfaces of the pair of second side walls 51 respectively comprise first side surfaces 511 opposite to each other and second side surfaces 512 opposite to each other, and the first side surfaces 511 and the second side surfaces 512 are at two ends of the insulated base 5.

In this embodiment, more specifically, a width between two opposite of the first side surfaces 511 of the pair of second side walls 51 is less than a width between two opposite of the second side surfaces 512 of the pair of second side walls 51. Two opposite first side surfaces 511 and two opposite second side surfaces 512 are at both ends of the insulated base 5, respectively. The first side surface 511 and the second side surface 512 at the side portion of one end of the insulated base 5 are adjacent to each other and at different horizontal planes. Hence, the first side surface 511 and the second side surface 512 adjacent to the first side surface 511 form a stair structure.

In this embodiment, the second terminals 6 are respectively held in the pair of second side walls 51 and two sides of guiding column 541.

In this embodiment, the second terminals 6 are arranged on the insulated base 5 and arranged in two opposite rows.

Each of the second terminals 6 comprises an arm portion, a pair of elastic clamping arms, a fixed arm, and a second welding portion which is passing through the bottom of the insulated base 5. Moreover, each of the second terminals 6 is a blanking-type terminal.

In this embodiment, the arm portion is laterally arranged under the bottom wall, while the pair of elastic clamping arms extends outwardly from one side surface of the arm portion toward the terminal slots. The elastic clamping arms is a flexible clamping structure. When the first connector 100 is inserted into the second connector 200, the elastic clamping arm swings with the fixed arm as the fulcrum.

In this embodiment, the elastic clamping arm has an arc protrusion relatively protruding outwardly. The two arc protrusions are in the second connection space 53, and the arc protrusions correspond to the turning sections of the second terminals 6 so as to guide the first connector 100 to be smoothly inserted into the second connector 200. Moreover, the pair of elastic clamping arms and the arm portion are formed as a U-shaped structure. With the two arc protrusions, the second terminal 6 provides two-point contacts and a clamping structure with two flexible arms, thereby having good anti vibration and anti-loosening effects.

In this embodiment, the fixed arm extends outwardly from the other side of the arm portion. The fixed arm, the pair of elastic clamping arms, and the arm portion are together formed as a laid-down E-shaped structure.

In this embodiment, each of the positioning members 7 comprises a second covering plate 71 and a plurality of second side plates 72 integrally formed with each other.

In this embodiment, each of the second covering plates 71 is held in the outer surface 522 of each of the second end walls 52. An end top plate 711 extends from each of the second covering plates 71 and covers a top portion of each of the second end walls 52. An end contact sheet 712 is in the second connection space 53 and bends inwardly from the end top plate 711, and the end contact sheet 712 covers an inner surface 521 of each of the second end walls 52.

In this embodiment, each of the second side plates 72 is held in an outer surface of each of the side walls 51. A first side top plate 721 and a second side top plate 722 extend from each of the second side plates 72 and cover a top portion of each of the second side walls 51.

In this embodiment, each of the second side plates 72 comprises a side contact sheet 724 and a plurality of contact arms 725. Each of the side contact sheets 724 is in the second connection space 53 and bends inwardly from each of the first side top plates 721, and each of the side contact sheets 724 covers each of the first side surfaces 511. Each of the contact arms 725 is in the second connection space 53 and bends inwardly from each of the second side top plates 722, and each of the contact arms 725 covers each of the second side surfaces 512.

In this embodiment, more specifically, each of the contact arms 725 comprises an extension arm 726 and an elastic arm 727. The extension arm 726 extends toward an inner portion of the second connection space 53. The elastic arm 727 extends and bends from an end portion of the extension arm 726. The extension arm 726 and the elastic arm 727 of the contact arm 725 of the second connector 200 have the same width. In this embodiment, each of the contact arms 725 and each of the second side plates 72 are integrally formed with each other. Each of the contact arms 725 extends inwardly from the second side top plate 722 of each of the second side plates 72. From a side view, the extension arm 726 and the elastic arm 727 are together formed as a U-shaped structure.

In this embodiment, more specifically, from a top view, each of the positioning members 7 is approximately formed as an upside-down U-shaped plate. a width between two opposite of the elastic arms 727 is less than a width between the side contact sheets 724. Two opposite side contact sheets 724 and two opposite contact arms 725 are at both ends of the insulated base 5, respectively. The side contact sheet 321 and the contact arm 725 at the side portion of one end of the insulated base 5 are adjacent to each other and at different horizontal planes.

In this embodiment, more specifically, a width between two opposite of the side contact sheets 724 is less than a width between two opposite of the first side surfaces 511.

In this embodiment, the positioning member 7 is a large-area enclosing structure. The second covering plates 71 and the second side plates 72 respectively cover the pair of second side walls 51 and the pair of second end walls 52 of the insulated base 5. Hence, impacts from outside can be stood effectively and the mating/unmating times for the connector can be increased. Moreover, the end contact sheets 712, the side contact sheets 724, and the contact arms 725 provide multi-point contacts. Accordingly, as the connector has two or more contact points, the stability of large current output can be ensured, and the mating force for the connector can be increased.

In this embodiment, more particularly, a plurality of concave portions 716 is recessed from a bottom end of each of the second covering plates 71. Accordingly, the contact areas of the concave portions 716 of the second covering plates 71 increase. Hence, when the second connector 200 is welded on the circuit board, the proper fixation for solder contact as well as multi-point welding design can be provided. The concave portions 716 can store excess solder to avoid solder crawling, thereby effectively avoiding product failure. The multi-point welding design ensures that the connector product is not easy to detach from the board and avoids open circuit of components.

Please refer to FIG. 15, an electrical connector assembly of a third embodiment of the instant disclosure is illustrated. FIG. 15 illustrates a cross-sectional view showing that an first connector is mated with a second connector of the third embodiment. In this embodiment, the electrical connector assembly comprises a first connector 100 (plug) and a second connector 200 (receptacle) capable of being mated with each other, and the electrical connector assembly belongs to the board to board (BTB) electrical connector.

Please refer to FIGS. 2, 9, and 15. In this embodiment, each of the fastening members 3 of the first connector 100 has the first side plate 321 and the second side plate 322 formed as a stair structure for protecting the insulated body 1. The configuration of the fastening member 3 is suitable for mating with the contact arm 725 of the second connector 200, so that the contact arm 725 is configured to extend to form the extension arm 726 and the elastic arm 727 with longer lengths, providing better elastic recovery effect, thereby reducing the risk of elastic fatigue as well as the risk of contact failure.

Please refer to FIGS. 2, 9, and 15. In this embodiment, more specifically, the side contact sheet 724 of each of the second side plates 72 of the second connector can be in interfering contact with the first side plate 321 of the first connector 100, so that the mating force between the first connector 100 and the second connector 200 can be increased.

Please refer to FIGS. 2, 9, and 15. In this embodiment, more specifically, the end top plate 711 of the second covering plate 71 and the first side top plate 721 of the second side plate 72 of the second connector 200 are higher than the surface of the guiding column 54. Therefore, when the first connector 100 is mated with the second connector 200, the first connector 100 can be guided by the end top plates 711 and the first side top plates 721 of the second connector 200.

According to one or some embodiments of the instant disclosure, the fastening member is an enclosing structure. The first covering plates, the first side plates, and the second side plates respectively cover the pair of first side walls and the pair of first end walls of the insulated body, so that the first covering plates, the first side plates, and the second side plates provide multi-point contacts. Accordingly, as the connector has two or more contact points, the stability of current output can be ensured, the requirements for large-current transmission can be achieved, and the heat generated by the elements can be reduced. The connector is applicable for quick charging purposes.

According to one or some embodiments of the instant disclosure, the fastening member has a first side plate and a second side plate formed as a stair structure for protecting the insulated body. The configuration of the fastening member is suitable for mating with the contact arm of the second connector, so that the contact arm is configured to extend to form the extension arm and the elastic arm with longer lengths, providing better elastic recovery effect, thereby reducing the risk of elastic fatigue as well as the risk of contact failure. Moreover, the extension arm and the elastic arm of the contact arm of the second connector have the same width (instead of an inwardly extending structure), and the contact area between the elastic arm and the fastening member is large.

According to one or some embodiments of the instant disclosure, the positioning member is a large-area enclosing structure. The second covering plates and the second side plates respectively cover the pair of second side walls and the pair of second end walls of the insulated base. Hence, impacts from outside can be stood effectively and the mating/unmating times for the connector can be increased. Moreover, the end contact sheets, the side contact sheets, and the contact arms provide multi-point contacts. Accordingly, as the connector has two or more contact points, the stability of large current output can be ensured, and the mating force for the connector can be increased.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A first connector, comprising:

an insulated body comprising a pair of first side walls and a pair of first end walls, wherein the pair of first side walls and the pair of first end walls are enclosed to form a first connection space, and an outer surface of each of the first side walls comprises a first side surface and a second side surface, wherein a position of the second side surface is different from a position of the first side surface and wherein a width between two opposite of the first side surfaces of the pair of first side walls is greater than a width between two opposite of the second side surfaces of the pair of first side walls;

a plurality of first terminals held in the pair of first side walls; and a plurality of fastening members, wherein each of the fastening members comprises:

a first covering plate, wherein each of the first covering plates is held in an outer surface of each of the first end walls, and an end top plate extends from each of the first covering plates and covers a top portion of each of the first end walls;

a plurality of first side plates, wherein the first side plates bend and extend from two sides of the end top plate of each of the first covering plates toward the first side surfaces; and a plurality of second side plates, wherein the second side plates bend and extend from the two sides of the end top plate of each of the first covering plates toward the second side surfaces.

2. The first connector according to claim 1, wherein a width between two opposite of the first side plates is greater than a width between two opposite of the second side plates.

3. The first connector according to claim 2, wherein a surface of each of the first side walls comprises a plurality of blocks, each of the blocks is between each of the first side plates and each of the second side plates adjacent to the first side plate.

4. A first connector, comprising:

an insulated body comprising a pair of first side walls and a pair of first end walls, wherein the pair of first side walls and the pair of first end walls are enclosed to form a first connection space, and an outer surface of each of the first side walls comprises a first side surface and a second side surface, wherein a position of the second side surface is different from a position of the first side surface;

a plurality of first terminals held in the pair of first side walls; and a plurality of fastening members, wherein each of the fastening members comprises:

a first covering plate, wherein each of the first covering plates is held in an outer surface of each of the first end walls, and an end top plate extends from each of the first covering plates and covers a top portion of each of the first end walls, wherein a bottom end of each of the first covering plates comprises a plurality of legs extending out of each of the first side walls;

a plurality of first side plates, wherein the first side plates bend and extend from two sides of the end top plate of each of the first covering plates toward the first side surfaces; and a plurality of second side plates, wherein the second side plates bend and extend from the two sides of the end top plate of each of the first covering plates toward the second side surfaces.

5. The first connector according to claim 4, wherein a width between two opposite of the first side surfaces of the pair of first side walls is greater than a width between two opposite of the second side surfaces of the pair of first side walls.

6. The first connector according to claim 5, wherein a width between two opposite of the first side plates is greater than a width between two opposite of the second side plates.

7. The first connector according to claim 6, wherein a surface of each of the first side walls comprises a plurality of blocks, each of the blocks is between each of the first side plates and each of the second side plates adjacent to the first side plate.

8. A second connector, comprising:

an insulated base comprising a pair of second side walls and a pair of second end walls, wherein the pair of second side walls and the pair of second end walls are enclosed to form a second connection space, the insulated base comprises a guiding column in the second connection space, and an inner surface of each of the second side walls comprises a first side surface and a second side surface, wherein a position of the second side surface is different from a position of the first side surface;

a plurality of second terminals respectively held in the pair of second side walls and two sides of the guiding column; and a plurality of positioning members, wherein each of the positioning members comprises:

a second covering plate, wherein each of the second covering plates is held in an outer surface of each of the second end walls, an end top plate extends from each of the second covering plates and covers a top portion of each of the second end walls, an end contact sheet is in the second connection space and bends inwardly from each of the end top plates, and the end contact sheet covers an inner surface of each of the second end walls; and a plurality of second side plates, wherein each of the second side plates is held in an outer surface of each of the second side walls, a first side top plate and a second side top plate extend from each of the second side plates and cover a top portion of each of the second side walls; each of the second side plates comprises a side contact sheet and a plurality of contact arms; each of the side contact sheets is in the second connection space and bends inwardly from each of the first side top plates, and each of the side contact sheets covers each of the first side surfaces; each of the contact arms is in the second connection space and bends inwardly from each of the second side top plates, and each of the contact arms covers each of the second side surfaces.

9. The second connector according to claim 8, wherein a width between two opposite of the side contact sheets is less than a width between two opposite of the first side surfaces.

10. The second connector according to claim 8, wherein a width between two opposite of the first side surfaces of the pair of second side walls is less than a width between two opposite of the second side surfaces of the pair of second side walls.

11. The second connector according to claim 10, wherein each of the contact arms comprises an extension arm and an elastic arm, the extension arm extends toward an inner portion of the second connection space, and the elastic arm extends and bends from an end portion of the extension arm.

12. The second connector according to claim 11, wherein a width between two opposite of the elastic arms is less than a width between two opposite of the side contact sheets.

* * * * *